US005731138A

United States Patent [19]

Helling et al.

[11] Patent Number: 5,731,138

[45] Date of Patent: Mar. 24, 1998

[54] COLOR PHOTOGRAPHIC MATERIAL

[75] Inventors: Günter Helling, Odenthal; Beate Weber, Leichlingen; Markus Geiger, Langenfeld, all of Germany

[73] Assignee: Agfa-Gevaert AG, Germany

[21] Appl. No.: 592,692

[22] Filed: Jan. 26, 1996

[30] Foreign Application Priority Data

Feb. 7, 1995 [DE] Germany ..... 195 03 885.1

[51] Int. Cl.[6] ..... G03C 1/08; G03C 7/26; G03C 7/32

[52] U.S. Cl. ..... 430/551; 430/558; 430/627; 430/631; 430/505; 430/502; 430/503

[58] Field of Search ..... 430/502, 503, 430/505, 543, 551, 558, 567, 627, 631

[56] References Cited

U.S. PATENT DOCUMENTS

| | | | |
|---|---|---|---|
| 5,242,788 | 9/1993 | Takahashi et al. | 430/558 |
| 5,397,688 | 3/1995 | Yoshioka | 430/551 |
| 5,474,882 | 12/1995 | Shono | 430/551 |
| 5,538,842 | 7/1996 | Takahashi et al. | 430/551 |
| 5,567,578 | 10/1996 | Makuta et al. | 430/551 |
| 5,576,165 | 11/1996 | Nozawa et al. | 430/551 |

*Primary Examiner*—Geraldine Letscher
*Attorney, Agent, or Firm*—Connolly & Holt

[57] ABSTRACT

A color photographic material which contains in at least one layer a stabilizer of the formula (I)

(I)

in which $R_1$ means H, alkyl, aryl or acyl;

$R_2$ means —$OR_1$, —COOH, alkyl, aryl, dialkylamino, acylamino, sulphonamido, acyl or sulphonyl;

$R_3$, $R_4$, $R_5$ and $R_6$ independently of one another mean H, halogen or a residue as $R_2$ or two adjacent residues —$OR_1$, $R_2$, $R_3$, $R_4$, $R_5$ and $R_6$ may together complete a 5- to 8-membered ring, and a polymer insoluble in water as pH 5 and soluble at pH 11 with an acid value of 30 to 300 and a Tg of≦40° C. of the formula (II)

(II)

in which $R_7$ mutually independently mean hydrogen, $C_1$–$C_4$ alkyl or $CH_2$—COOH, $R_8$ means alkyl, aryl or aralkyl a means 80 to 95 mol. % and b means 5 to 20 mol. %, is distinguished by improved stability of the image dyes.

14 Claims, No Drawings

COLOR PHOTOGRAPHIC MATERIAL

This invention related to a color photographic material with improved light stability of the image dyes produced on chromogenic development, in particular of the magenta azomethine dyes, which stability is obtained by the combination of certain stabilisers and certain polymers.

It is known to produce colour photographic images by chromogenic development, i.e. by developing silver halide emulsion layers which have been exposed in accordance with an image by means of suitable chromogenic developer substances, known as colour developers, in the presence of suitable colour couplers, wherein the oxidation product of the developer substances, which is formed congruently with the silver image, reacts with the colour coupler forming a dye image. Aromatic compounds containing primary amino groups, particularly those of the p-phenylenediamine type, are usually used as colour developers.

It is also known that colour couplers may be dispersed in polymers which are insoluble in water and soluble in organic solvents.

DE 4 136 965, for example, suggests dispersing couplers in polymers soluble in organic solvents in order to improve the light stability of dyes. Known polymers do not, however, fulfil in every respect the requirements placed upon them. According to JP-N 1 183 650 the colour yield and moisture/heat or darkness/heat stability of dyes may be improved by polymers with an aromatic chain. However, due to inadequate light stability, these polymers have the disadvantage that they cause unwanted discolouration of the image whites.

EP 178 794, 264 730, 273 412, 273 712 and 457 543 and U.S. Pat. No. 5,104,782 describe compounds which improve the light stability of photographic image dyes, in particular dyes of pyrazolotriazole couplers.

EP 486 216 describes the use of stabilisers together with polymers insoluble in water and soluble in organic solvents.

Prior art measures do not yet achieve adequate light stability in the area of low colour densities and adequate colour densities. Prior art mixtures moreover tend to crystallise.

The object of the invention is to provide suitable polymers as high-boiling solvents, which dissolve the couplers and stabilisers, contribute towards improving the stability of image dyes, do not crystallise and do not reduce maximum density.

It has surprisingly now been found that these objects may be achieved with specific (meth) acrylates.

The present invention thus provides a colour photographic material which contains on a support at least one blue-sensitive silver halide emulsion layer containing at least one yellow coupler, at least one green-sensitive silver halide emulsion layer containing at least one magenta coupler, at least one red-sensitive silver halide emulsion layer containing at least one cyan coupler, together with conventional non-photosensitive layers, characterised in that at least one layer contains a stabiliser of the formula (I)

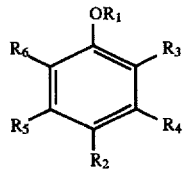

(I)

in which $R_1$ means H, alkyl, aryl, acyl;

$R_2$ means —$OR_1$, —COOH, alkyl, aryl, dialkylamino, acylamino, sulphonamido, acyl, sulphonyl;

$R_3$, $R_4$, $R_5$, $R_6$ mean H, halogen or a residue as $R_2$ or two adjacent residues —$OR_1$, $R_2$, $R_3$, $R_4$, $R_5$, $R_6$ may together complete a 5- to 8-membered ring, and a polymer insoluble in water at pH 5 and soluble at pH 11 with an acid value of 30 to 300 and a $T_g$ of≦40° C. of the formula (II)

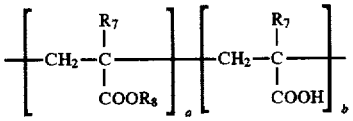

(II)

in which $R_7$ mutually independently mean hydrogen, $C_1$–$C_4$ alkyl or $CH_2$—COOH, $R_8$ means alkyl, aryl, aralkyl means 80 to 95 mol. % and b means 5 to 20 mol. %.

$R_7$ is preferably H or $CH_3$; $R_8$ is preferably $C_1$–$C_8$ alkyl.

$T_g$ is preferably≦10° C.; the acid value is preferably 40 to 150.

Insoluble at pH 5 means that less than 1 wt. % dissolves in water at this pH value and 20° C.; soluble at pH 11 means that at least 20 wt. % dissolve in water at this pH value and 20° C.

The polymers have (number average) molecular weights of approximately 1000 to 30000, preferably of 1000 to 15000. The polymers used are in particular those which are viscous liquids.

Suitable polymers of the formula (II) are

| | | Tg (°C.) | Acid Value |
|---|---|---|---|
| P-1 | $-[CH_2-CH]_{89}-[CH_2-CH]_{11}-$ ($COOC_2H_5$; COOH) | −14 | 63 |
| P-2 | $-[CH_2-CH]_{60}-[CH_2-CH]_{32}-[CH_2-C(CH_3)]_{8}-$ ($COOC_2H_5$; $COOC_4H_9$; COOH) | −25 | 40 |
| P-3 | $-[CH_2-CH]_{17}-[CH_2-CH]_{78}-[CH_2-C(CH_2-COOH)]_{5}-$ ($COO-C_3H_7$-i; $COO-C_6H_{13}$; COOH) | −37 | 38 |
| P-4 | $-[CH_2-C(CH_3)]_{35}-[CH_2-CH]_{58}-[CH_2-CH]_{7}-$ ($COOC_4H_9$; $COOC_4H_9$; COOH) | −22 | 30 |
| P-5 | $-[CH_2-CH]_{83}-[CH_2-C(CH_3)]_{17}-$ ($COO-C_2H_5$; COOH) | −9 | 97 |
| P-6 | $-[CH_2-CH]_{81}-[CH_2-CH]_{5}-[CH_2-CH]_{14}-$ ($COO-C_4H_9$; $COO-CH_2$–C$_6$H$_5$; COOH) | −32 | 64 |
| P-7 | $-[CH_2-CH]_{78}-[CH_2-CH]_{3}-[CH_2-C(CH_3)]_{19}-$ ($COO-C_8H_{17}$i; $COOCH_3$; COOH) | −26 | 65 |
| P-8 | $-[CH_2-CH]_{9}-[CH_2-CH]_{79}-[CH_2-CH]_{12}-$ ($COO-C_4H_9$; COOH; $COO-CH_2$–C$_6$H$_4$–Cl) | −28 | 52 |
| P-9 | $-[CH_2-CH]_{68}-[CH_2-C(CH_3)]_{32}-$ ($COO-C_4H_9$; COOH) | −33 | 155 |

The polymers which are usable according to the invention may be produced by bulk polymerisation, solution polymerisation, suspension polymerisation or emulsion polymerisation. Suitable initiators for these polymerisation reactions are water-soluble or oleophilic. Examples of water-soluble initiators are: potassium peroxydisulphate, ammonium persulphate and potassium persulphate, water-soluble azo compounds such as 4,4'-azo-bis-4-cyanovaleric acid sodium salt, 2,2'-azo-bis-(2-aminodipropane) hydrochloride, t.-butyl hydroperoxide and hydrogen peroxide. Examples of oleophilic polymerisation initiators are oleophilic azo compounds such as azobisbutyronitrile, 2,2-azo-bis-2,4-dimethylvaleric acid nitrile and oleophilic peroxides such as benzoyl peroxide, lauryl peroxide, dibutyl peroxide and t.-butyl peroctoate.

Chain-transfer agents may be used to produce polymers with low molecular weights. Another suitable possibility is to use solvents with elevated transfer constants, as are described in Polymer Handbook, third edition, John Wiley & Sons, New York, p. II/81.

The production of P-5 is described below by way of example.

A mixture of 40 g of t.-butanol, 10.00 g of ethyl acrylate and 1.8 g of methacrylic acid is heated to 75° C. under nitrogen. 1.1 g of t.-butyl peroctoate as a 50 wt. % solution in t.-butanol are then added dropwise and the mixture stirred for 4 hours at 75° C. Once the solution has cooled, the polymer is precipitated by being stirred into ice/water, filtered out and rewashed with water. Yield: 90%.

The polymers of the formula (II) are in particular used in a quantity of 0.2 to 10 g/g of coupler.

One acyl group $R_2$, also in this connection as acylamino, is in particular derived from a carboxylic, carbamic, carbonic or sulphonic acid.

The compounds of the formula (I) are in particular used in a quantity of 0.05 to 3 g/g of coupler.

In further preferred embodiments of the invention, the compound of the formula (I) is in particular of one of the formulae (Ia) to (Ih).

(Ia)

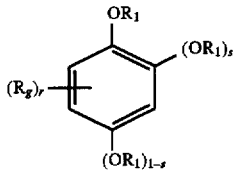

(Ib)

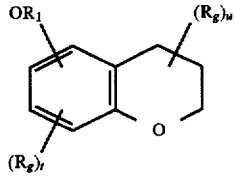

(Ic)

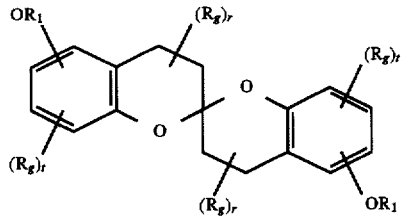

(Id)

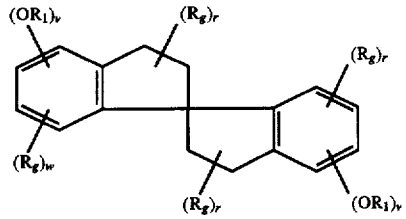

(Ie)

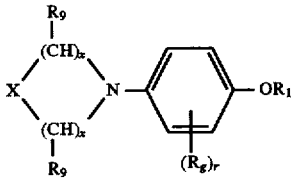

IIf)

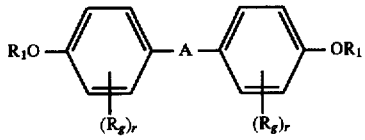

-continued (Ig)

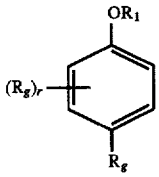

(Ih)

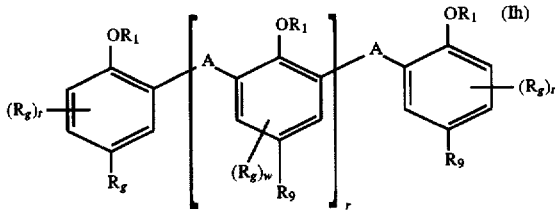

in which $R_9$ means alkyl, acyl, acylamino, sulphonamido, sulphonyl;

A means a single bond, —CH($R_{10}$)—, —O—, —S—, —$SO_2$—, —$NR_{11}$—,

X means —O—, —S—, —SO—, —$SO_2$—, —Nacyl—, —CO—;

$R_{10}$ means H, alkyl, $R_{11}$ means H, alkyl, acyl, sulphonyl, r means 0, 1, 2, 3 or 4;

s means 0 or 1;

t means 0, 1, 2 or 3;

u means 0, 1, 2, 3, 4, 5 or 6;

v means 1 or 2;

w means 0, 1 or 2 and x means 1, 2 or 3.

Two or more residues $R_9$ or r, t, v, w, x may be identical or different. The situation described for $R_1$ to $R_6$ applies to the acyl group contained in the residue X (formula Ie) and to any possible acyl group in the residues $R_9$ and $R_{11}$.

Compounds Ie and Ih are particularly preferred.

Examples of compounds of the formula (I) according to the invention are:

C-1
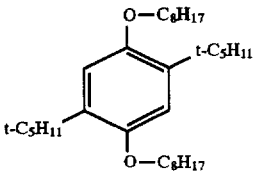
C-2
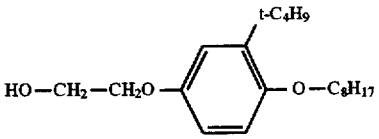
C-3
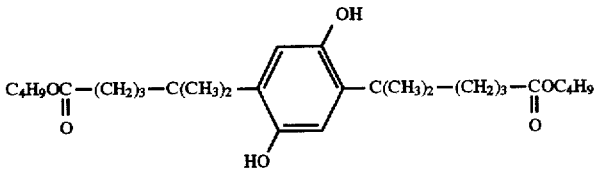
C-4
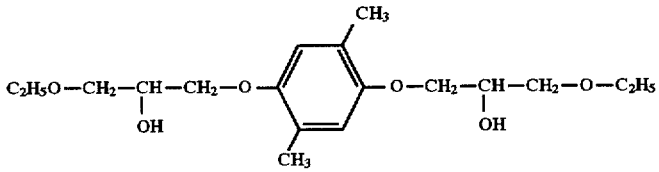
C-5
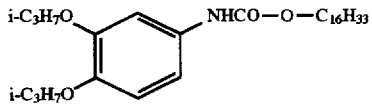
C-6
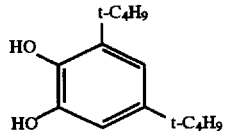
C-7
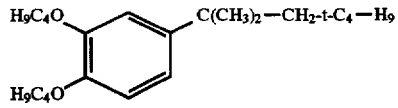
C-8
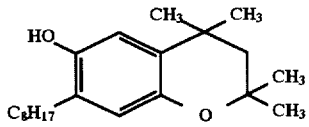
C-9
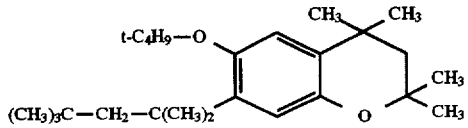
C-10
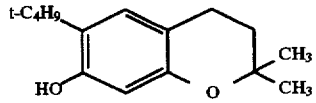

-continued
C-11
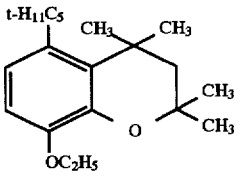
C-12
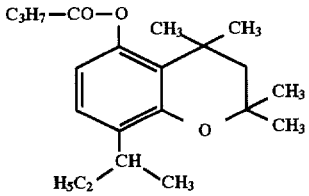
C-13
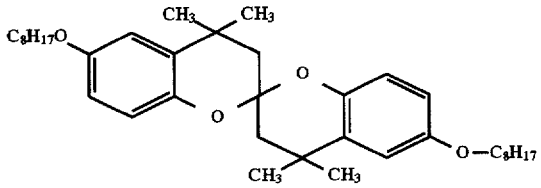
C-14
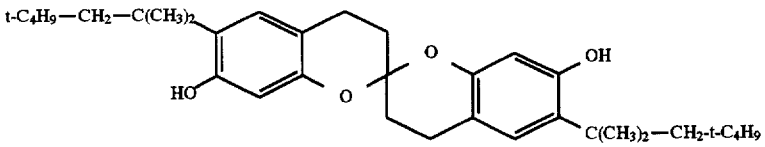
C-15
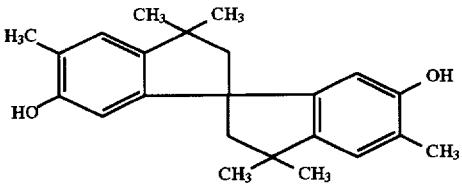
C-16
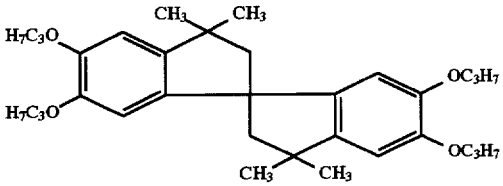
C-17
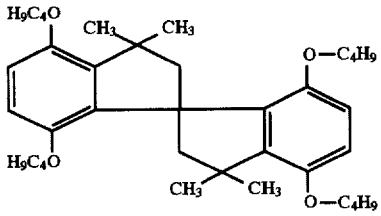
C-18
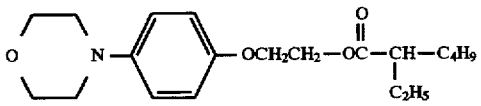
C-19
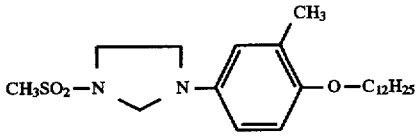

-continued
C-20
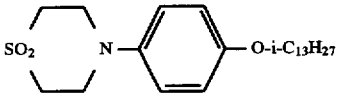
C-21
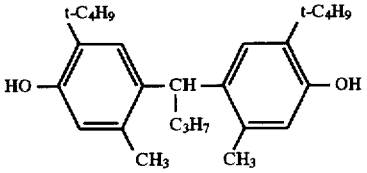
C-22
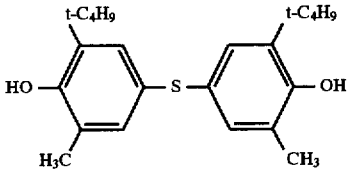
C-23
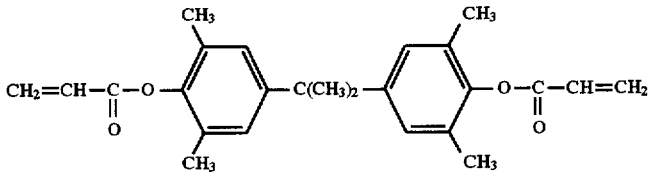
C-24
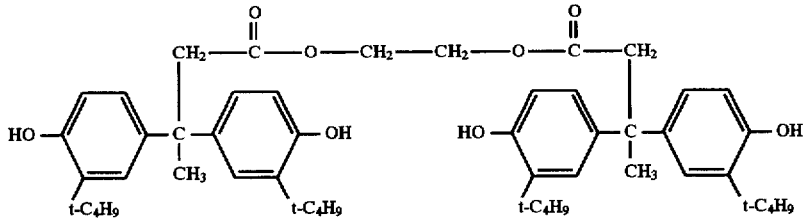
C-25
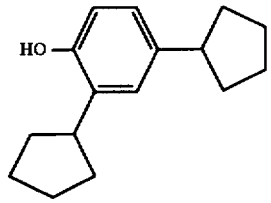
C-26
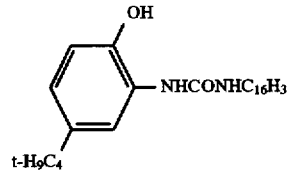
C-27
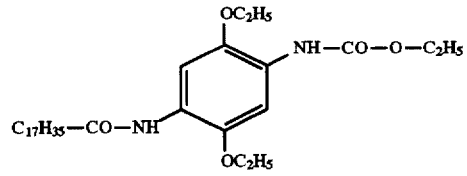
C-28
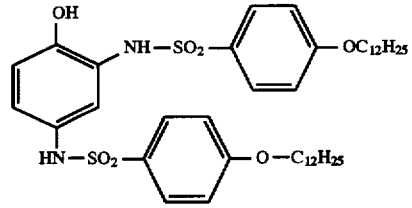

-continued

C-29

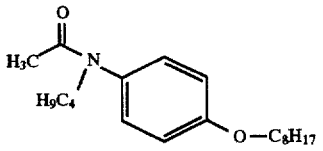

C-30

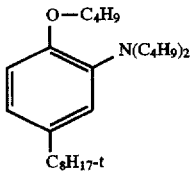

C-31

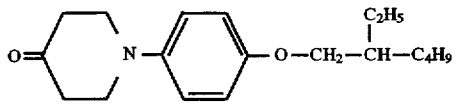

C-32

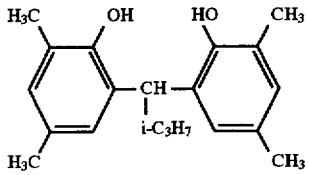

C-33

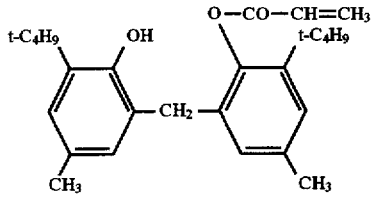

C-34

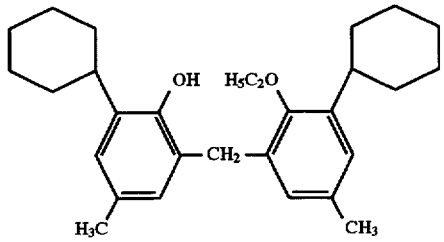

C-35

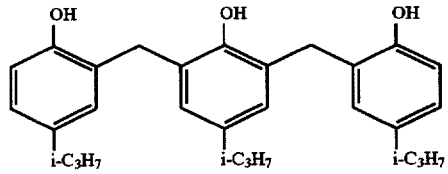

C-36

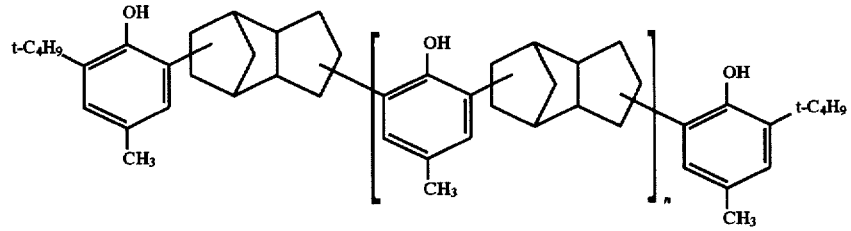

with n=2.5.

The colour photographic recording material according to the invention contains at least one photosensitive silver halide emulsion layer and preferably a sequence of two or more such photosensitive silver halide emulsion layers and optionally further auxiliary layers, such as in particular protective layers and non-photosensitive binder layers arranged between the photosensitive layers, wherein according to the present invention a compound according to the invention in combination with a colour coupler, preferably a magenta coupler, is associated with at least one of the photosensitive silver halide emulsion layers present.

The polymers and stabilisers according to the invention are preferably used in the layer or layers which contain magenta couplers.

The silver halide present as the photosensitive constituent in the photographic recording material according to the invention may contain chloride, bromide or iodide or mixtures thereof as the halide. The halide content of at least one layer may, for example, consist of 0 to 15 mol. % of iodide, 0 to 100 mol. % of chloride and 0 to 100 mol. % of bromide. Preferred emulsions contain 95 to 100 mol. % of AgCl and 0 to 5 mol. % of AgBr.

In the case of colour negative and colour reversal films, silver bromide-iodide emulsions are conventionally used, in the case of colour negative and colour reversal paper, silver chloride-bromide emulsions with a high chloride content up to pure silver chloride emulsions are conventionally used. The crystals may be predominantly compact, for example regularly cubic or octahedral, or they may have transitional shapes. Preferably, however, lamellar crystals may also be present, the average ratio of diameter to thickness of which is preferably at least 5:1, wherein the diameter of a grain is defined as the diameter of a circle the contents of which correspond to the projected surface area of the grain. The layers may, however, also have tabular silver halide crystals in which the ratio of diameter to thickness is substantially greater than 5:1, for example 12:1 to 30:1.

The silver halide grains may also have a multi-layered grain structure, in the simplest case with one internal zone and one external zone of the grain (core/shell), wherein the halide composition and/or other modifications, such as for example doping, of the individual grain zones are different. The average grain size of the emulsions is preferably between 0.2 μm and 2.0 μm, the grain size distribution may be both homodisperse and heterodisperse. A homodisperse grain size distribution means that 95% of the grains deviate by no more than±30% from the average grain size.

The emulsions may, in addition to the silver halide, also contain organic silver salts, for example silver benzotriazolate or silver behenate.

Two or more types of silver halide emulsions which are produced separately may be used as a mixture.

The emulsions may be chemically and/or spectrally sensitised in the conventional manner; they may also be stabilised with suitable additives. Suitable chemical sensitisers, spectral sensitising dyes and stabilisers are, for example, described in *Research Disclosure* 17643 (December 1978); particular reference is made to sections III, IV and VI.

The colour photographic recording material according to the invention preferably contains, apart from the usually green-sensitised silver halide emulsion layer containing the combination according to the invention of stabiliser and polymer, further silver halide emulsion layers to record the light from the red and blue ranges of the spectrum. For this purpose, the photosensitive layers are spectrally sensitised in a known manner with suitable sensitising dyes.

A review of the polymethine dyes suitable as spectral sensitisers, suitable combinations of the dyes and the combinations with supersensitising effects is contained in *Research Disclosure* 17643 (December 1978), section IV.

Examples of suitable green sensitisers are 9-ethylcarbocyanines with benzoxazole, naphthoxazole or a benzoxazole and a benzothiazole as basic terminal groups, together with benzimidazocarbocyanines, which may also be further substituted and must also contain at least one sulphoalkyl group on the heterocyclic nitrogen.

Each of the stated photosensitive layers may consist of a single layer or, in a known manner, for example in the so-called double layer arrangement, may also comprise two or more partial layers of silver halide emulsion (DE-C-1 121 470). In negative films, red-sensitive silver halide emulsion layers are conventionally arranged closer to the film base than green-sensitive silver halide emulsion layers and these in turn are closer than blue-sensitive layers, wherein there is generally a non-photosensitive yellow filter layer between the green-sensitive layers and the blue-sensitive layers. Other arrangements are, however, conceivable, for example in colour paper. A non-photosensitive interlayer is generally arranged between layers of differing spectral sensitivity, which interlayer may contain agents to suppress unwanted diffusion of developer oxidation products. If two or more silver halide emulsion layers of the same spectral sensitivity are present, they may be immediately adjacent to each other or arranged in such a manner that a photosensitive layer with a different spectral sensitivity is located between them (DE-A-1 958 709, DE-A-2 530 645, DE-A-2 622 922).

Colour photographic recording materials according to the invention conventionally contain colour couplers spatially and spectrally associated with the silver halide emulsion layers of differing spectral sensitivity to produce the different cyan, magenta and yellow partial colour images, wherein the compounds according to the invention are, together with the colour coupler concerned, preferably associated with a green-sensitive silver halide emulsion layer.

A spatial association should here be taken to mean that the colour coupler is arranged spatially in relation to the silver halide emulsion layer in such a manner that it is possible for them to interact, so permitting the silver image formed on development to be congruent with the colour image produced from the colour coupler. This is generally achieved by the colour coupler being contained in the silver halide layer itself or in an adjacent, optionally non-photosensitive, binder layer.

A spectral association should here be taken to mean that there is a particular relationship between the spectral sensitivity of each of the photosensitive silver halide emulsion layers and the colour of the partial colour image produced from the particular spatially associated colour coupler, wherein each of the spectral sensitivities (red, green, blue) is associated with another colour of the partial colour image concerned (for example, cyan, magenta, and yellow, in this order).

One or also more colour couplers may be associated with each of the differently spectrally sensitised silver halide emulsion layers. If two or more silver halide emulsion layers of the same spectral sensitivity are present, each of these may contain a colour coupler, wherein these colour couplers need not necessarily be identical. They should merely produce at least approximately the same colour on colour development, normally a colour which is complementary to the colour of the light to which the particular silver halide emulsion layers are predominantly sensitive.

Cyan couplers are generally couplers of the phenol or α-naphthol type.

Yellow couplers are generally couplers with an open-chain ketomethylene grouping, in particular couplers of the α-acylacetamide type, for example benzoylanilide couplers and α-pivaloylacetanilide couplers.

Magenta couplers are generally couplers of the 5-pyrazolone, indazolone or pyrazoloazole type.

In a preferred embodiment, the recording material of the present invention contains as magenta coupler compounds of the formula III

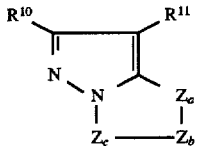

(III)

in which $R^{10}$ means H, alkyl, aralkyl, aryl, alkoxy, aroxy, alkylthio, arylthio, amino, anilino, acylamino, cyano, alkoxycarbonyl, carbamoyl, sulphamoyl, wherein these residues may be further substituted and $R^{11}$ means H or a group which may be liberated by coupling;

$Z_a$, $Z_b$, $Z_c$ mean an optionally substituted methine group, =N— or —NH—, wherein either the $Z_a$–$Z_b$ bond or the $Z_b$–$Z_c$ bond is a double bond and the other bond is a single bond.

Couplers of the formula III are briefly described as pyrazoloazole couplers. Such couplers are, in particular, taken to be couplers derived from imidazolo[1,2-b]pyrazole, imidazolo [3,4-b]pyrazole, pyrazolo[2,3-b]pyrazole, pyrazolo[3,2-c]-1,2,4-triazole, pyrazolo[2,3-b]-1,2,4-triazole, pyrazolo[2,3-c]-1,2,3-triazole or pyrazolo[2,3-d] tetrazole. The corresponding structures are shown below in the formulae IIIa to IIIg.

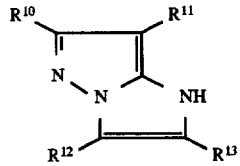

(IIIa)

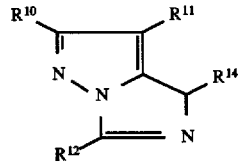

(IIIb)

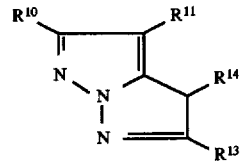

(IIIc)

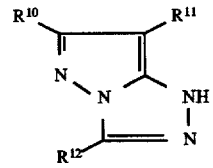

(IIId)

-continued

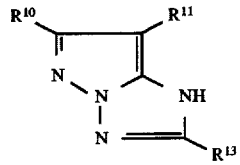

(IIIe)

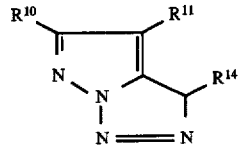

(IIIf)

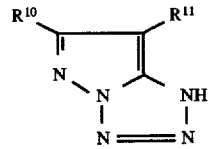

(IIIg)

In the general formulae (IIIa) to (IIIg), the residues $R^{10}$, $R^{12}$, $R^{13}$ and $R^{14}$ denote hydrogen, alkyl, aralkyl, aryl, alkoxy, aroxy, alkylthio, arylthio, amino, anilino, acylamino, cyano, alkoxycarbonyl, carbamoyl, sulphamoyl, wherein these residues may be further substituted.

Residues $R^{11}$, which may be eliminated on colour coupling, are for example a halogen atom or a preferably cyclic group attached to the coupling site via an oxygen atom, a sulphur atom or a nitrogen atom.

If the eliminable group is a cyclic group, the attachment to the coupling site of the coupler molecule may be achieved either directly via an atom which is a constituent part of a ring, for example a nitrogen atom, or indirectly via an intermediate linking member. Such eliminable groups are known in great numbers, for example as the fugitive groups of 2-equivalent magenta couplers.

Examples of eliminable groups attached via oxygen are of the formula $$—O—R^{15},$$

in which $R^{15}$ denotes an acyclic or cyclic organic residue, for example alkyl, aryl, a heterocyclic group or acyl, which is, for example, derived from an organic carboxylic or sulphonic acid.

In particularly preferred eliminable groups of this type, $R^{15}$ means an optionally substituted phenyl group.

Examples of eliminable groups attached via nitrogen are described in the following German published patent applications: 25 36 191, 27 03 589, 28 13 522, 33 39 201.

These groups are in many cases 5-membered heterocyclic rings, which are attached to the coupling site of the magenta coupler via a nitrogen atom of the ring. Many of the heterocyclic rings contain activating groups, for example carbonyl or sulphonyl groups, or double bonds adjacent to the nitrogen atom effecting the bond to the coupler molecule.

If the eliminable group is attached to the coupling site of the coupler via a sulphur atom, this group may be the residue of a diffusible carbocyclic or heterocyclic mercapto compound, which is capable of inhibiting the development of silver halide. Such inhibitor residues have frequently been described as an eliminable group attached to the coupling site of couplers, including magenta couplers, for example in U.S. Pat. No. 3,227,554.

Of the pyrazoloazole couplers, those of the formulae (IIId) and (IIIe) are preferred. In the formulae IIId and IIIe, preferably at least one of the residues $R^{10}$ and $R^{13}$ denotes a secondary alkyl or tertiary alkyl residue.
Examples of pyrazoloazole couplers of the formula III are:
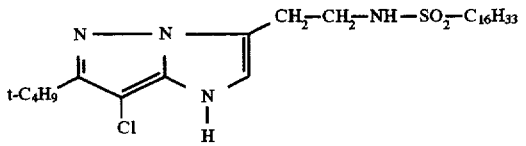
III-1
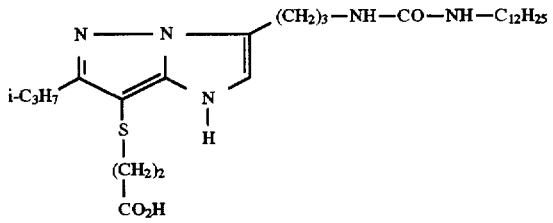
III-2
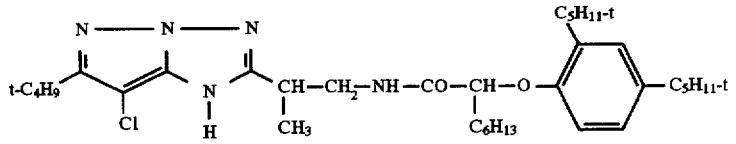
III-3
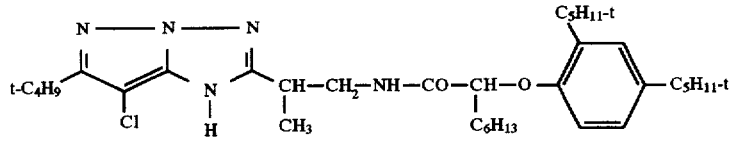
III-4
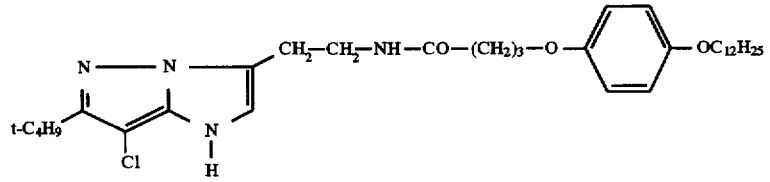
III-5
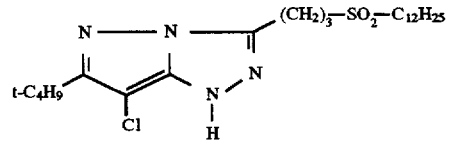
III-6
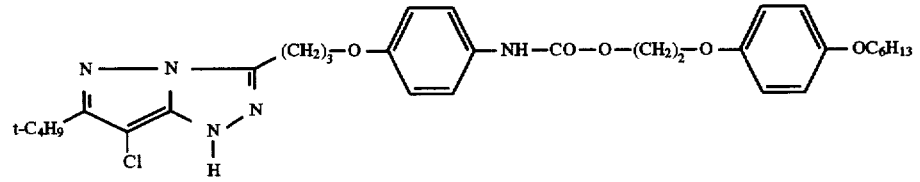
III-7
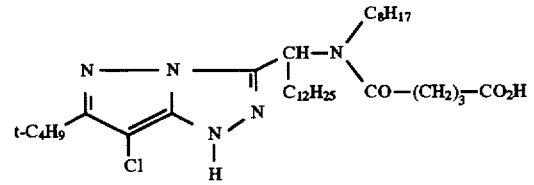
III-8
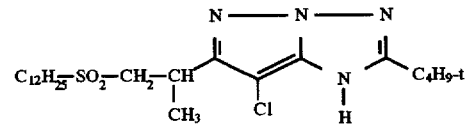
III-9

-continued
III-10
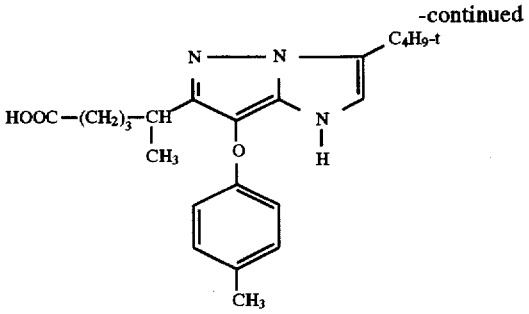
III-11
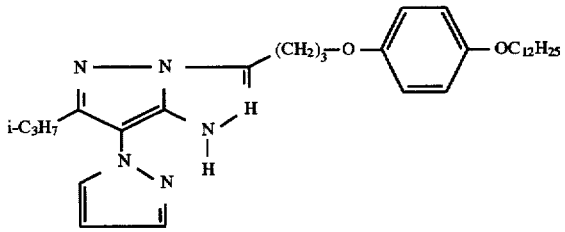
III-12
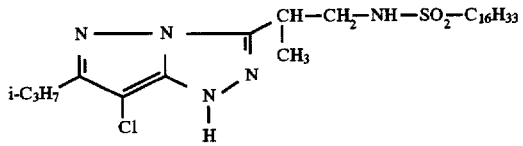
III-13
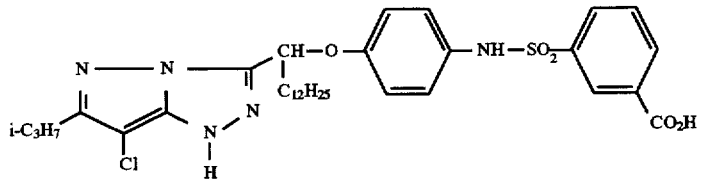
III-14
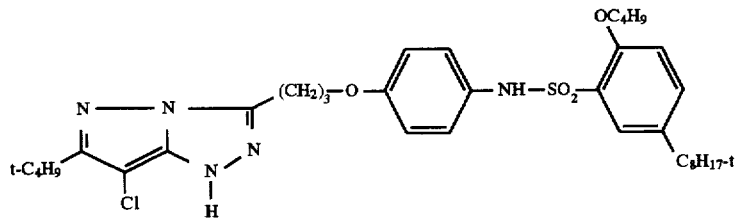
III-15
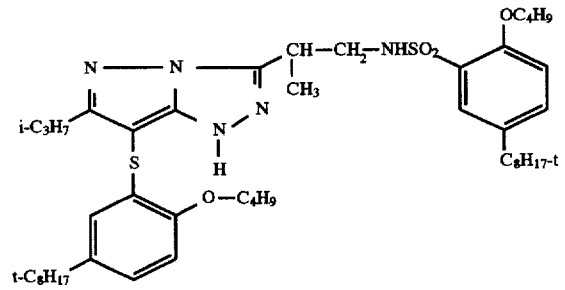
III-16
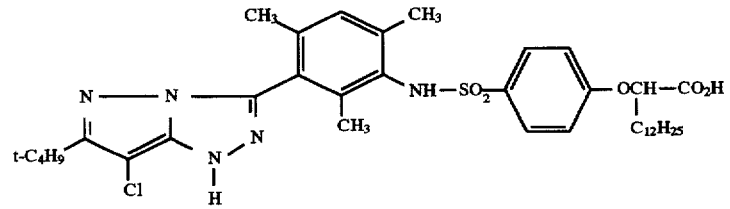

-continued
III-17
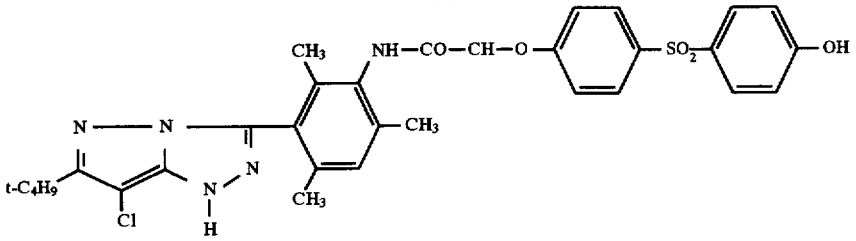
III-18
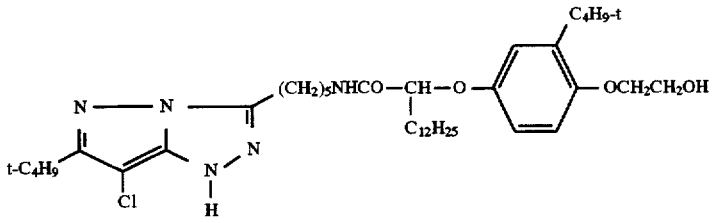
III-19
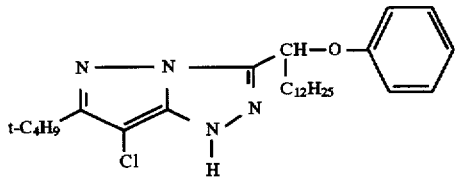
III-20
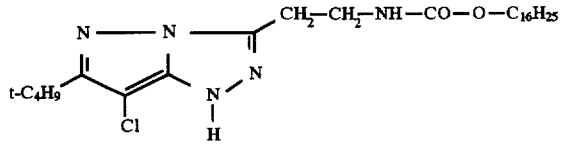
III-21
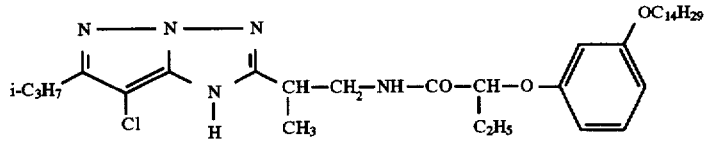
III-22
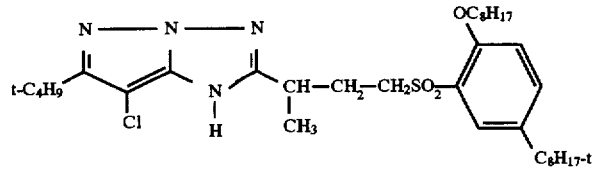
III-23
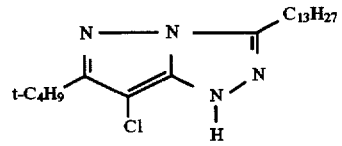
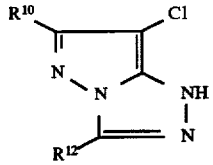
III-24
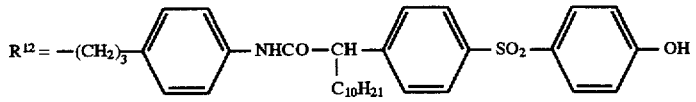
$R^{10} = CH_3$ -continued
III-25
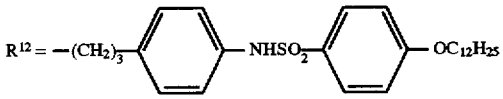
$R^{10} = CH_3$
III-26
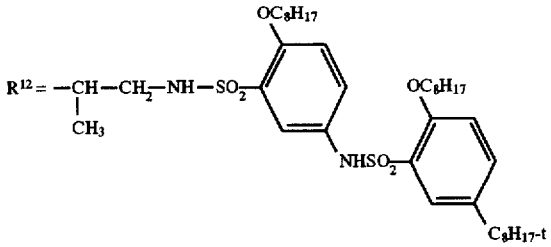
$R^{10} = CH_2—CH(CH_3)_2$
III-27
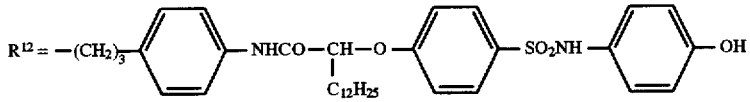
$R^{10} = —CH_3$
III-28
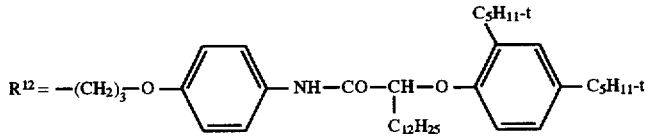
$R^{10} = —CH_3$
III-29
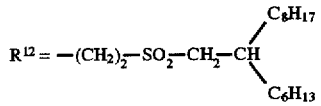
$R^{10} = —CH_3$
III-30
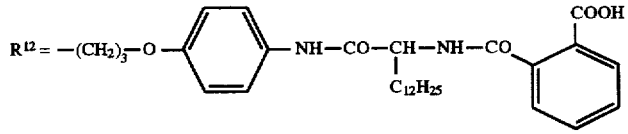
$R^{10} = —CH_3$
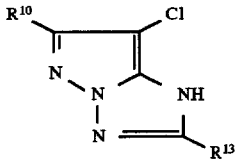
III-31
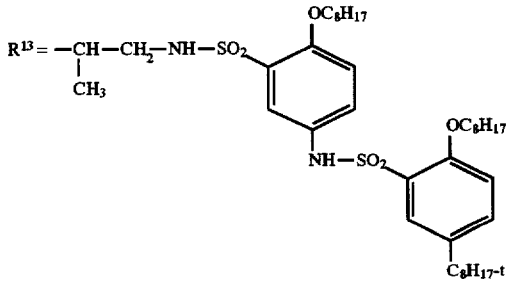
$R^{10} = —CH_3$ -continued

III-32

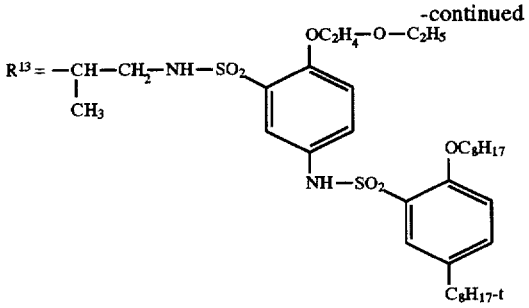

$R^{10} = -CH_3$

III-33

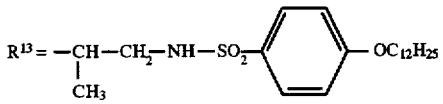

$R^{10} = -C_3H_7\text{-n}$

III-34

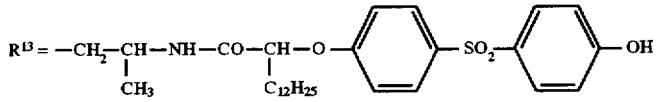

$R^{10} = -CH_3$ $R^{13} = -CH_2-CH_2-OCH_3$

III-35

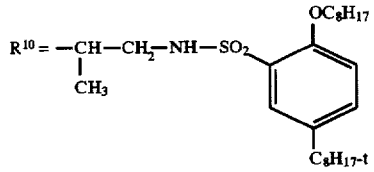

The colour couplers may be 4-equivalent couplers, but they may also be 2-equivalent couplers. The latter are differentiated from 4-equivalent couplers by containing a substituent at the coupling site which is eliminated on coupling. 2-equivalent couplers are considered to be those which are colourless, as well as those which have an intense intrinsic colour which on colour coupling disappears or is replaced by the colour of the image dye produced (masking couplers), and white couplers which, on reaction with colour developer oxidation products, give rise to substantially colourless products. 2-equivalent couplers are further considered to be those which contain an eliminable residue at the coupling site, which residue is liberated on reaction with colour developer oxidation products and so either directly or after one or more further groups have been eliminated from the initially eliminated residue (for example, DE-A-27 03 145, DE-A-28 55 697, DE-A-31 05 026, DE-A-33 19 428), produces a specific desired photographic effect, for example as a development inhibitor or accelerator. Examples of such 2-equivalent couplers are the known DIR couplers as well as DAR or FAR couplers.

The couplers used, in particular the pyrazoloazole type magenta couplers preferably used according to the invention, for example of the formulae IIId and IIIe may also be used in polymeric form, for example as a polymer latex.

High-molecular weight colour couplers are, for example, described in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat No. 4,080,211. The high-molecular weight colour couplers are generally produced by polymerisation of ethylenically unsaturated monomeric colour couplers.

The colour couplers used may also be those which yield dyes with weak or restricted mobility.

Weak or restricted mobility is taken to be mobility which is calculated such that the contours of the discrete dye spots formed on chromogenic development run and smudge together. This degree of mobility should be distinguished, on the one hand, from the conventional case of complete immobility within photographic layers which is sought for the colour couplers or the dyes produced from them in conventional photographic recording materials in order to ensure the greatest possible sharpness and, on the other hand, from complete dye mobility which is, for example, sought in the dye diffusion process. The last stated dyes generally have at least one group which renders them soluble in an alkaline medium. The extent of the weak mobility sought according to the invention may be controlled by varying the substituents in order, for example, to exert a specific effect upon solubility in the organic medium of the oil former or affinity for the binder matrix.

The colour photographic recording material of the present invention may contain further additives, in addition to the stated constituents, for example antioxidants, dye stabilising agents, and agents to control mechanical and electrostatic properties, together with UV absorbers. Such additional compounds are advantageously combined with the compounds according to the invention, i.e. used in the same binder layer or in adjacent binder layers.

These further additives to improve the stability of dyes, couplers and whites and to reduce colour fogging (*Research*

*Disclosure* 17 643 (December 1978), section VII) may belong to the following classes of chemical substances: hydroquinones, 6-hydroxychromans, 5-hydroxycoumarans, spirochromans, spiroindans, p-alkoxyphenols, sterically hindered phenols, gallic acid derivatives, methylene dioxybenzenes, aminophenols, sterically hindered amines, derivatives with esterified or etherified phenolic hydroxyl groups, metal complexes.

Compounds having both a sterically hindered amine partial structure and a sterically hindered phenol partial structure in a single molecule (U.S. Pat No. 4,268,593) are particularly effective in preventing the impairment of yellow colour images as a consequence of the development of heat, moisture and light.

UV light absorbing compounds are intended on the one hand to protect the colour dyes from bleaching by high-UV daylight and on the other hand to absorb the UV light in daylight on exposure and so improve the colour reproduction of a film. Conventionally, compounds of differing structure are used for the two tasks. Examples are aryl-substituted benzotriazole compounds (U.S. Pat No. 3,533,794), 4-thiazolidone compounds (U.S. Pat No. 3,314,794 and 3,352,681), benzophenone compounds (JP-A-2784/71), cinnamic acid ester compounds (U.S. Pat. No. 3,705,805 and 3,707,375), butadiene compounds (U.S. Pat. No. 4,045,229) or benzoxazole compounds (U.S. Pat. No. 3,700,455).

In order to produce colour photographic images, the colour photographic recording material, which contains associated with at least one silver halide layer a magenta coupler and a combination of a compound of the formula I and a (meth) acrylate, is developed with a colour developer. Colour developer compounds which may be used are all developer compounds having the ability to react, in the form of their oxidation product, with colour couplers to yield azomethine dyes. Suitable colour developer compounds are aromatic compounds containing at least one primary amino group of the p-phenylenediamine type, for example N,N-dialkyl-p-phenylenediamines such as N,N-diethyl-p-phenylene-diamine, 1-(N-ethyl-N-methanesulphonamidoethyl)-3-methyl-p-phenylenediamine, 1-(N-ethyl-N-hydroxyethyl-3-methyl-p-phenylenediamine, 1-(N-ethyl-N-[3-hydroxypropyl])-3-methyl-p-phenylenediamine and 1-(N-ethyl-N-methoxyethyl)-3-methyl-p-phenylenediamine.

Further usable colour developers are, for example, described in *J. Amer. Chem. Soc.* 73, 3100 (1951) and in G. Haist *Modern Photographic Processing*, 1979, John Wiley & Sons, New York, pages 545 et seq.

After colour development, the material is conventionally bleached and fixed. Bleaching and fixing may be performed separately or together. Conventional compounds may be used as bleaches, for example $Fe^{3+}$ salts and $Fe^{3+}$ complex salts such as ferricyanides, dichromates, water soluble cobalt complexes etc. Iron-III complexes of aminopolycarboxylic acids are particularly preferred, especially, for example, of ethylenediaminetetraacetic acid, N-hydroxyethylethylenediaminetriacetic acid, alkyliminodicarboxylic acids and of corresponding phosphonic acids. Persulphates are also suitable as bleaches.

EXAMPLES

Example 1

Sample 1.1 (comparison)

A film base of paper coated on both sides with polyethylene was provided with the following layers. The stated quantities relate to 1 $m^2$.

| | |
|---|---|
| Layer 1 | A substrate layer prepared from 200 mg of gelatine. |
| Layer 2 | A green-sensitive silver bromide-chloride emulsion layer (99.5 mol. % chloride) prepared from 530 mg of $AgNO_3$ with 750 mg of gelatine, 0.61 g of magenta coupler III-23, emulsified with 0.61 g of emulsifier VP-1 0.50 g of C-20 and 0.20 g of C-24. |
| Layer 3 | A protective layer prepared from 1 g of gelatine and 120 mg of a hardener of the formula |

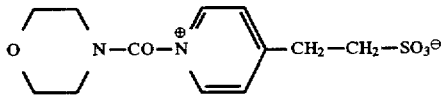

(HM-1)

Samples 1.2 to 1.10

Samples 1.2 to 1.10 were produced in the same manner as sample 1, with the difference that the VP-1 used in sample 1.1 was replaced with the polymers stated in table 1.

The samples obtained were exposed behind a graduated grey wedge and processed in the following manner using the processing baths listed below:

a) Colour developer-45 s-35° C.

| | |
|---|---|
| Triethanolamine | 9.0 g |
| N,N-diethylhydroxylamine | 4.0 g |
| Diethylene glycol | 0.05 g |
| 3-methyl-4-amino-N-ethyl-N-methane-sulphonaminoethylaniline sulphate | 5.0 g |
| Potassium sulphite | 0.2 g |
| Triethylene glycol | 0.05 g |
| Potassium carbonate | 22 g |
| Potassium hydroxide | 0.4 g |
| Ethylenediaminetetraacetic acid, disodium salt | 2.2 g |
| Potassium chloride | 2.5 g |
| 1,2-dihydroxybenzene-3,4,6-trisulphonic acid, trisodium salt | 0.3 g |
| make up with water to 1000 ml; pH 10.0. | |

b) Bleaching/fixing bath-45 s-35° C.

| | |
|---|---|
| Ammonium thiosulphate | 75 g/l |
| Sodium hydrogen sulphite | 13.5 g/l |
| Ammonium acetate | 2.0 g/l |
| Ethylenediaminetetraacetic acid (iron-ammonium salt) | 57 g/l |
| Ammonia, 25 wt. % | 9.5 g/l |
| Acetic acid | 9.0 g/l |
| make up with water to 1000 ml; pH 5.5. | |

c) Rinsing-2 min-35° C.

d) Drying

The processed samples were then covered with a UV protective film and irradiated in a xenon tester to determine light fastness ($14.4 \cdot 10^6$ l×h).

The UV protective film was produced as follows: a layer prepared from 1.5 g of gelatine, 0.65 g of UV absorber UV-1, 0.07 g of dioctylhydroquinone and 0.36 g of TCP were applied onto a transparent cellulose triacetate film provided with a coating of a coupling agent. The quantities are for 1 $m^2$.

The results are shown in table 1.

As is shown by table 1, using the compounds according to the invention as the coupler solvent distinctly increases the light stability of the magenta dye in comparison with polymers having a low acid value.

TABLE 1

| Sample | Polymer | Acid value mg KOH/g | Loss in density (%) at density 1.0 | 0.6 |
|---|---|---|---|---|
| 1.1 comparison | VP-1 | 2 | 44 | 64 |
| 1.2 comparison | VP-2 | 1 | 43 | 62 |
| 1.3 comparison | VP-3 | 3 | 54 | 70 |
| 1.4 according to the invention | P-1 | 63 | 32 | 46 |
| 1.5 according to the invention | P-2 | 40 | 35 | 50 |
| 1.6 according to the invention | P-4 | 30 | 35 | 48 |
| 1.7 according to the invention | P-6 | 64 | 31 | 45 |
| 1.8 according to the invention | P-9 | 155 | 32 | 47 |
| 1.9 comparison | VP-4 | 2 | 52 | 68 |
| 1.10 comparison | VP-5 | 3 | 49 | 63 |

Comparison polymers:

VP-1: methyl/n-butyl methacrylate copolymer, 50 mol. % each; $T_g$ 80° C.

VP-2: polymethyl methacrylate; $T_g$ 105° C.

VP-3: polyethyl methacrylate; $T_g$ 65° C.

VP-4: polybutyl methacrylate; $T_g$ 15° C.

VP-5: 1,4-butanediol/adipic acid polyester; $T_g$ −68° C.

Example 2

A multilayer colour photographic recording material was produced by applying the following layers in the stated order onto a film base of paper coated on both sides with polyethylene. All quantities relates to 1 $m^2$, the quantity of silver is stated as $AgNO_3$:

Sample 2.1

1st layer (substrate layer) 0.10 g of gelatine

2nd layer (blue-sensitive layer)

Blue-sensitive silver halide emulsion (99.5 mol. % chloride and 0.5 mol. % bromide, average grain diameter 0.9 μm) prepared from
0.50 g of $AgNO_3$ and
1.25 g of gelatine
0.42 g of yellow coupler Y-1
0.18 g of yellow coupler Y-2
0.50 g of tricresyl phosphate (TCP)
0.10 g of stabiliser ST-1
0.70 mg of blue sensitiser S-1
0.30 mg of stabiliser ST-2

3rd layer (interlayer)

1.10 g of gelatine
0.06 g of scavenger O-1
0.06 g of scavenger O-2
0.12 g of TCP 4th layer (green-sensitive layer)

Green-sensitised silver halide emulsion (99.5 mol. % chloride, 0.5 mol. % bromide, average grain diameter 0.47 μm) prepared from
0.30 g of $AgNO_3$ and
1.00 g of gelatine
0.30 g of magenta coupler III-23
0.25 g of image stabiliser C-20
0.15 g of image stabiliser C-24
0.40 g of dibutyl phthalate (DBP)
0.70 mg of green sensitiser S-2
0.50 mg of stabiliser ST-4

5th layer (UV protective layer)

1.15 g of gelatine
0.50 g of UV absorber UV-1
0.10 g of UV absorber UV-2
0.03 g of oxform scavenger O-1
0.03 g of oxform scavenger O-2
0.35 g of TCP 6th layer (red-sensitive layer)

Red-sensitised silver halide emulsion (99.5 mol. % chloride, 0.5 mol. % bromide, average grain diameter 5 μm) prepared from
30 g of $AgNO_3$ and
1.00 g of gelatine
0.46 g of cyan coupler C-1
0.46 g of TCP
0.03 mg of red sensitiser S-3
0.60 mg of stabiliser ST-5

7th layer (UV protective layer)

0.35 g of gelatine
0.15 g of UV absorber UV-1
0.03 g of UV absorber UV-2
0.09 g of TCP 8th layer (protective layer)

0.90 g of gelatine
0.05 g of optical whitener W-1
0.07 g of polyvinylpyrrolidone
1.20 g of silicone oil
2.50 mg of spacer (polymethyl methacrylate)
0.30 g of hardener HM-1

The colour photographic recording material is exposed through a step wedge. Additional filters are inserted in the beam path of the exposure device such that the wedge appears neutral at an optical density of D=0.6. The exposed material is processed in the same manner as the materials from example 1.

Sample 2.2

The layer structure was produced as in sample 2.1 with the difference that the polymer according to the invention P-1 was used instead of DBP in the fourth layer.

Sample 2.3

The layer structure was produced as in sample 2.1 with the difference that the poly-t.-butylacrylamide (PO-1) described in EP 486 216 was used instead of DBP in the fourth layer.

Sample 2.4

The layer structure was produced as in sample 2.1 with the difference that polyurethane VP-6 was used instead of DPB in the fourth layer.

After processing using the stated process, the minimum and maximum densities in the magenta layer are measured and light stability determined as described in example 1 (table 2).

The results show that usable casting mixtures are not obtained when stabilisers and known polymers such as PO-1 are used as additives to the magenta emulsion.

TABLE 2

| Sample | $D_{min}$ | $D_{max}$ | Coupler solvent | Acid value | Loss in density (%) at density 1.0 | Loss in density (%) at density 0.6 |
|---|---|---|---|---|---|---|
| 2.1 comparison | 0.011 | 2.55 | DBP | — | 36 | 58 |
| 2.2 according to the invention | 0.011 | 2.59 | P-1 | 63 | 25 | 41 |
| 2.3 comparison | 0.011 | * | PO-1 | — | * | * |
| 2.4 comparison | 0.011 | 2.56 | VP-6 | 3 | 34 | 48 |

*Unusable casting mixture as emulsion has crystallised. Impossible to state value.

Y-1

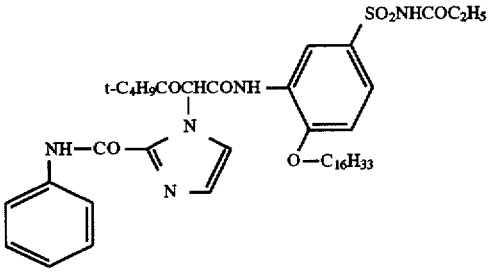

VP-6: Polyurethane prepared from adipic acid, butanediol and hexamethylene diisocyanate; $T_g$ −38° C.

Y-3

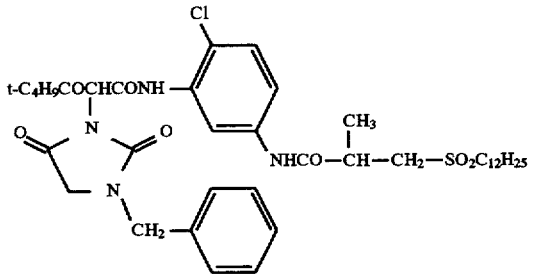

C-1

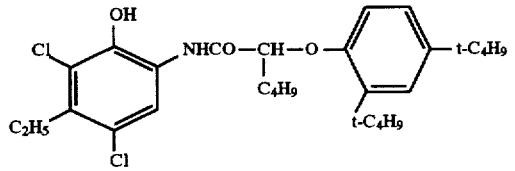

S-1

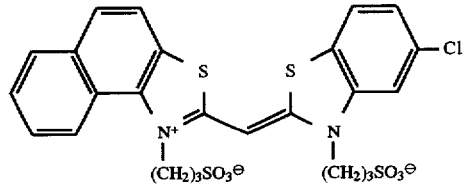

$Et_3N^+H$

TABLE 2-continued
S-2
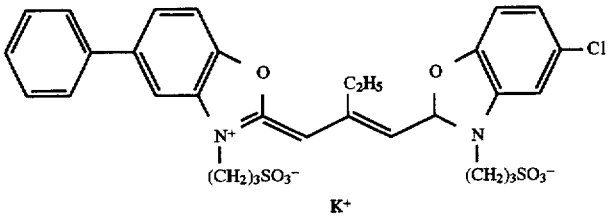
S-3
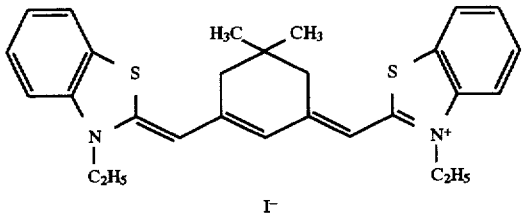
ST-1
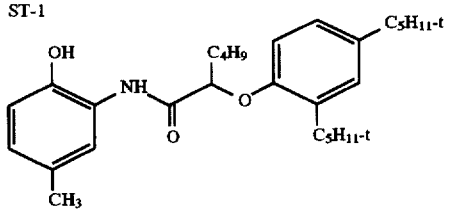
ST-2
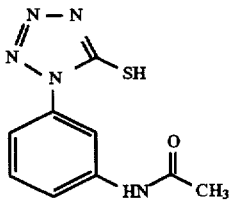
ST-3
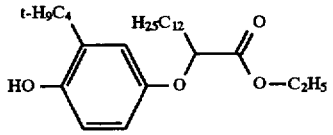
ST-4
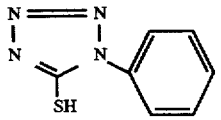
ST-5
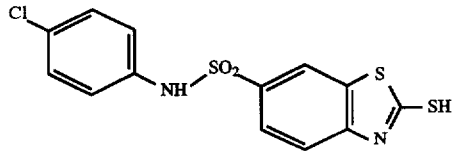

TABLE 2-continued

O-1

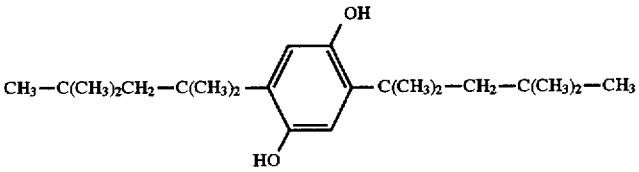

O-2

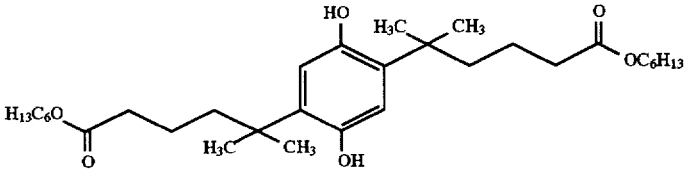

UV-1

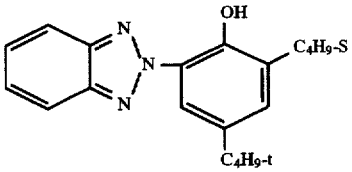

UV-2

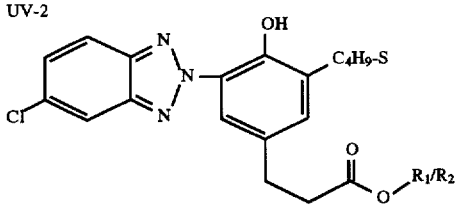

$R_1 = n\text{-}C_8H_{17}$ $R_2 = CH_2-CH(C_2H_5)-C_4H_9$ $R_1/R_2 = 1:1$

W-1

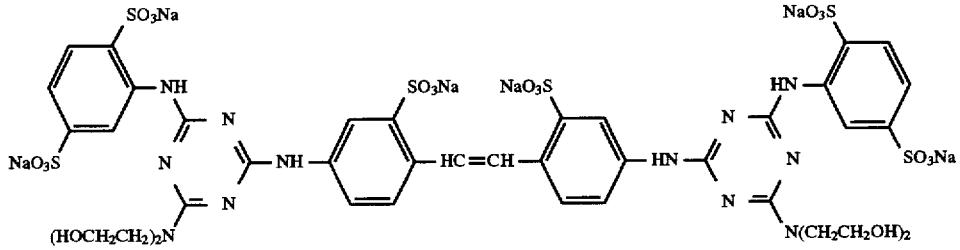

We claim:

1. A color photographic material which comprises on a support at least one blue-sensitive silver halide emulsion layer containing at least one yellow coupler, at least one green-sensitive silver halide emulsion layer containing at least one magenta coupler, at least one red-sensitive silver halide emulsion layer containing at least one cyan coupler, together with non-photosensitive layers, wherein at least one layer contains a stabilizer of formula (Ie)

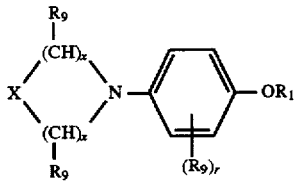

(Ie)

in which $R_1$ means H, alkyl, aryl or acyl;

$R_9$ means alkyl, acyl, acylamino, sulphonamido or sulphonyl;

X means —O—, —S—, —SO—, —$SO_2$—, —Nacyl— or —CO—;

r means 0, 1, 2, 3 or 4 and x means 1, 2 or 3;

and a polymer insoluble in water at pH 5 and soluble at pH 11 with an acid value of 30 to 300 and a Tg of<40° C. of the formula (II)

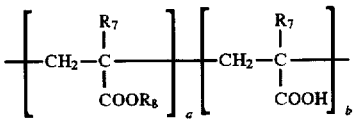

(II)

in which $R_7$ mutually independently mean hydrogen, $C_1$–$C_4$-alkyl or $CH_2$—COOH, $R_8$ means alkyl, aryl or aralkyl, a means 80 to 95 mol-% and b means 5 to 20 mol-%.

2. The color photographic material according to claim 1, wherein the polymer of the formula II has an acid value of 40 to 150 and a $T_g$ of≦10° C.

3. The color photographic material according to claim 1, wherein $R_7$ means H or $CH_3$ and $R_8$ means $C_1$–$C_8$ alkyl.

4. The color photographic material according to claim 1, wherein the compound of the formula Ie is used in a quantity of 0.05 to 3 g/g of coupler and the polymer of the formula II in a quantity of a 0.2 to 10 g/g of coupler.

5. The color photographic material according to claim 1, wherein the compounds of the formula Ie and the polymers of the formula II are used in a green-sensitive layer containing at least one magenta coupler.

6. The color photographic material according to claim 1, wherein the magenta coupler is of the formula III

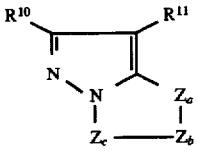

(III)

in which $R_{10}$ means H, alkyl, aralkyl, aryl, alkoxy, aroxy, alkylthio, arylthio, amino, anilino, acylamino, cyano, alkoxycarbonyl, carbamoyl or sulphamoyl, wherein these residues may be further substituted and $R^{11}$ means H or a group which may be liberated by coupling;

$Z_a$, $Z_b$ and $Z_c$ independently of one another mean an optionally substituted methine group, =N— or —NH—, wherein either the $Z_a$–$Z_b$ bond or the $Z_b$–$Z_c$ bond is a double bond and the other bond is a single bond.

7. The color photographic material according to claim 1, wherein the magenta coupler is of one of the formulae IIIa to IIIg

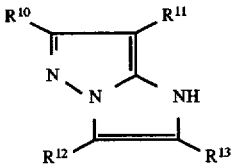

(IIIa)

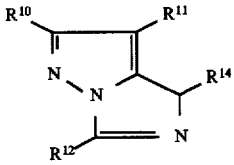

(IIIb)

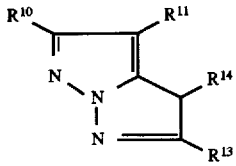

(IIIc)

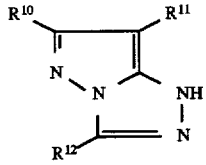

(IIId)

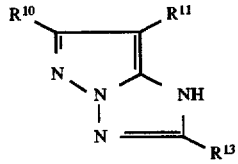

(IIIe)

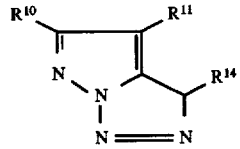

(IIIf)

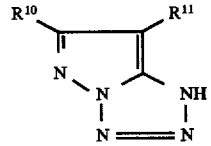

(IIIg)

in which $R^{10}$, $R^{12}$, $R^{13}$ and $R^{14}$ independently of one another denote hydrogen, alkyl, aralkyl, aryl, alkoxy, aroxy, alkylthio, arylthio, amino, anilino, acylamino, cyano, alkoxycarbonyl, carbamoyl or sulphamoyl, wherein these residues may be further substituted and $R^{11}$ is a residue which may be eliminated and color coupling.

8. The color photographic material according to claim 1, wherein the silver halide emulsions of all the silver halide emulsion layers consist of 95 to 100 mol. % of AgCl and 0 to 5 mol. % of AgBr.

9. The color photographic material according to claim 2, wherein the polymer of the formula II has a number average molecular weight of approximately 1,000 to 30,000.

10. The color photographic material according to claim 9, wherein the polymer has a number average molecular weight from 1,000 to 15,000, and is a polymer selected from the group consisting of P-1, P-2, P-3, P-4, P-5, P-6, P-7, P-8 and P-9.

| | | Tg (°C.) | Acid Value |
|---|---|---|---|
| P-1 | $-[CH_2-CH(COOC_2H_5)]_{89}-[CH_2-CH(COOH)]_{11}-$ | −14 | 63 |
| P-2 | $-[CH_2-CH(COOC_2H_5)]_{60}-[CH_2-CH(COOC_4H_9)]_{32}-[CH_2-C(CH_3)(COOH)]_{8}-$ | −25 | 40 |
| P-3 | $-[CH_2-CH(COO-C_3H_7i)]_{17}-[CH_2-CH(COO-C_6H_{13})]_{78}-[CH_2-C(CH_2-COOH)(COOH)]_{5}-$ | −37 | 38 |
| P-4 | $-[CH_2-C(CH_3)(COOC_4H_9)]_{35}-[CH_2-CH(COOC_4H_9)]_{58}-[CH_2-CH(COOH)]_{7}-$ | −22 | 30 |
| P-5 | $-[CH_2-CH(COO-C_2H_5)]_{83}-[CH_2-C(CH_3)(COOH)]_{17}-$ | −9 | 97 |
| P-6 | $-[CH_2-CH(COO-C_4H_9)]_{81}-[CH_2-CH(COO-CH_2-C_6H_5)]_{5}-[CH_2-CH(COOH)]_{14}-$ | −32 | 64 |
| P-7 | $-[CH_2-CH(COO-C_8H_{17}i)]_{78}-[CH_2-CH(COOCH_3)]_{3}-[CH_2-C(CH_3)(COOH)]_{19}-$ | −26 | 65 |
| P-8 | $-[CH_2-CH(COO-CH_2-C_6H_4-Cl)]_{9}-[CH_2-CH(COO-C_4H_9)]_{79}-[CH_2-CH(COOH)]_{12}-$ | −28 | 52 |
| P-9 | $-[CH_2-CH(COO-C_4H_9)]_{68}-[CH_2-C(CH_3)(COOH)]_{32}-$ | −33 | 155 |

11. The color photographic material according to claim 7, wherein $R^{11}$ is a halogen atom or a cyclic group attached to the coupling site via an oxygen atom, a sulphur atom or a nitrogen atom.

12. The color photographic material according to claim 7, wherein $R^{11}$ is of the formula —O—$R^{15}$, in which $R^{15}$ denotes an acyclic or cyclic organic residue.

13. The color photographic material according to claim 12, wherein $R^{15}$ is alkyl, aryl, a heterocyclic group or acyl.

14. The color photographic material according to claim 13, wherein $R^{15}$ is an optionally substituted phenyl group.

* * * * *